United States Patent [19]

Baugh

[11] 4,036,247

[45] July 19, 1977

[54] MULTI-PRESSURE, SINGLE LINE SUPPLY SYSTEM

[75] Inventor: Benton F. Baugh, Houston, Tex.

[73] Assignee: Vetco Offshore Industries, Inc.

[21] Appl. No.: 667,175

[22] Filed: Mar. 15, 1976

[51] Int. Cl.[2] ..... E21B 43/01

[52] U.S. Cl. ..... 137/236; 137/609; 166/.5; 166/75 R

[58] Field of Search ..... 60/416; 137/236, 609; 166/.5, 75 R

[56] References Cited

U.S. PATENT DOCUMENTS

| | | | |
|---|---|---|---|
| 3,718,316 | 2/1973 | Larralde et al. | 60/416 X |
| 3,993,100 | 11/1976 | Pollard et al. | 166/.5 X |

*Primary Examiner*—Martin P. Schwadron
*Assistant Examiner*—Gerald A. Michalsky
*Attorney, Agent, or Firm*—Pravel, Wilson & Gambrell

[57] ABSTRACT

A system for conveying fluid from a single subsea supply conduit to provide a fluid supply for each of a plurality of subsea well control apparatus requiring fluid supplies at different pressure levels. A fluid receiver receives fluid under pressure from the single subsea supply conduit, and a regulator regulates fluid flow from the receiver to charge one or more accumulators with fluid at desired pressure levels and to control injection of the fluid through an injection line into a subsea well flowline. The fluid used with the system may be glycol, methanol, or other suitable freezing retardants.

14 Claims, 2 Drawing Figures

MULTI-PRESSURE, SINGLE LINE SUPPLY SYSTEM

BACKGROUND OF THE INVENTION

The field of this invention is fluid supply systems and the like.

Offshore wells typically require a plurality of subsea well control devices which are remotely operated using fluid supplied from the ocean surface. Three basic functions performed by these control devices are control of gate valves, control of downhole safety valves, and injection of freezing retardant fluids into the flowlines coming from the wellhead. When flow valves in the wellhead are first opened and gas is released, gas in the flowline expands and may cause freezing. The injection of freezing retardant fluids such as methanol or glycol into the flowlines eliminates or reduces such freezing.

Typically, the devices which perform the three control functions mentioned above each require an operating fluid supplied at a different pressure level. For example, the control device for controlling gate valves may require operating fluid at a pressure of 1500 to 300 p.s.i., and the device for controlling downhole safety valves may require operating fluid at pressures on the order of 6000 p.s.i. while fluid is injected to the flowlines at relatively high and variable pressures typically in the range from 2000 p.s.i. to 4700 p.s.i.

Because of the differing fluid pressure requirements for the various control devices, operating fluid was often supplied through separate lines to each different control apparatus. Providing three or more flowlines for individually supplying operating fluid to the respective control devices was, of course, exceedingly expensive and somewhat unreliable. Other known systems employed booster arrangements and pumping arrangements to elevate the pressure of the operating fluid to the various desired levels. However, the addition of these active pumping means added not only expense but also inherent unreliability to such systems.

SUMMARY OF THE INVENTION

It is an object of this invention to provide a new and improved supply system.

The supply system of the present invention conveys fluid from a single subsea supply conduit to provide a fluid supply for each of a plurality of well control devices. The supply system is particularly adapted for use with well control devices, two or more of which have different supply pressure level requirements, and with a single subsea supply conduit which provides fluid alternately at such different pressure levels.

A first embodiment of the supply system of the present invention includes a fluid receiving means for receiving the fluid from the single subsea supply conduit and at least two accumulators, each of which is mounted in a separate line and operably connected to a separate well valve control device. Each of the accumulators is, however, maintained in interruptible fluid communication with the fluid receiving means. A charging means operably connected to the fluid receiving means and to each of the accumulators charges the accumulators independently of one another with fluid from the fluid receiving means. Because the accumulators are in interruptible fluid communication with the fluid receiving means and are charged independently of one another, the accumulators may be separately charged to different pressure levels as the single subsea supply conduit provides fluid to the fluid receiving means at such different pressure levels.

A second embodiment of the supply system of the present invention also includes a fluid receiving means for receiving fluid from the single subsea supply conduit. An injection means is in interruptible fluid communication with the fluid receiving means and controllably injects fluid from the fluid receiving means into a subsea well flowline. In addition, one or more accumulators are provided for supplying fluid to a subsea well valve control apparatus. The accumulator is mounted in a line separate from the injection means and is in interruptible fluid communication with the fluid receiving means for being charged with fluid from the fluid receiving means. A regulating means is operably connected to the fluid receiving means, the injection means, and the accumulator for regulating fluid flow from the fluid receiving means to control injection by the injection means and to control charging of the accumulator. The fluid used in the system is a freezing retardant fluid such as glycol or methanol, and this fluid serves as both the fluid for charging the accumulator and the fluid injected into the subsea well flowline by the injection means. One or more additional accumulators mounted in separate lines and connected to different control apparatus may also be placed in interruptible fluid communication with the fluid receiving means so that a plurality of accumulators may be charged independently of one another by the regulating means. The regulating means permits the accumulators to be charged to different pressure levels and fluid to be injected into a well flowline at a desired pressure level when the single subsea conduit provides fluid to the fluid receiving means at appropriate pressure levels.

With both embodiments of the supply system of the present invention, fluid is conveyed from a single subsea supply conduit to provide a fluid supply for each of a plurality of well control devices, even where the well control devices require fluid supplies at different pressure levels. The elimination of multiple subsea supply conduits significantly reduces the cost of remotely operating the subsea well control devices and provides additional reliability to the system. Additionally, the embodiments of the present invention eliminate the inherent unreliability of systems employing boosters, alternate pumps, and other active pumping means because no such additional pumping means is required with the system of the present invention. Further, the second embodiment of the present invention permits the use of a single freezing retardant fluid as both the operating fluid for well control valve apparatus and the fluid to be injected into a well flowline by the injection means. In this manner, separate flowlines carrying different injection and operating fluids are eliminated.

DETAILED DESCRIPTION OF THE PREFERRED EMBODIMENT

Figure 1:
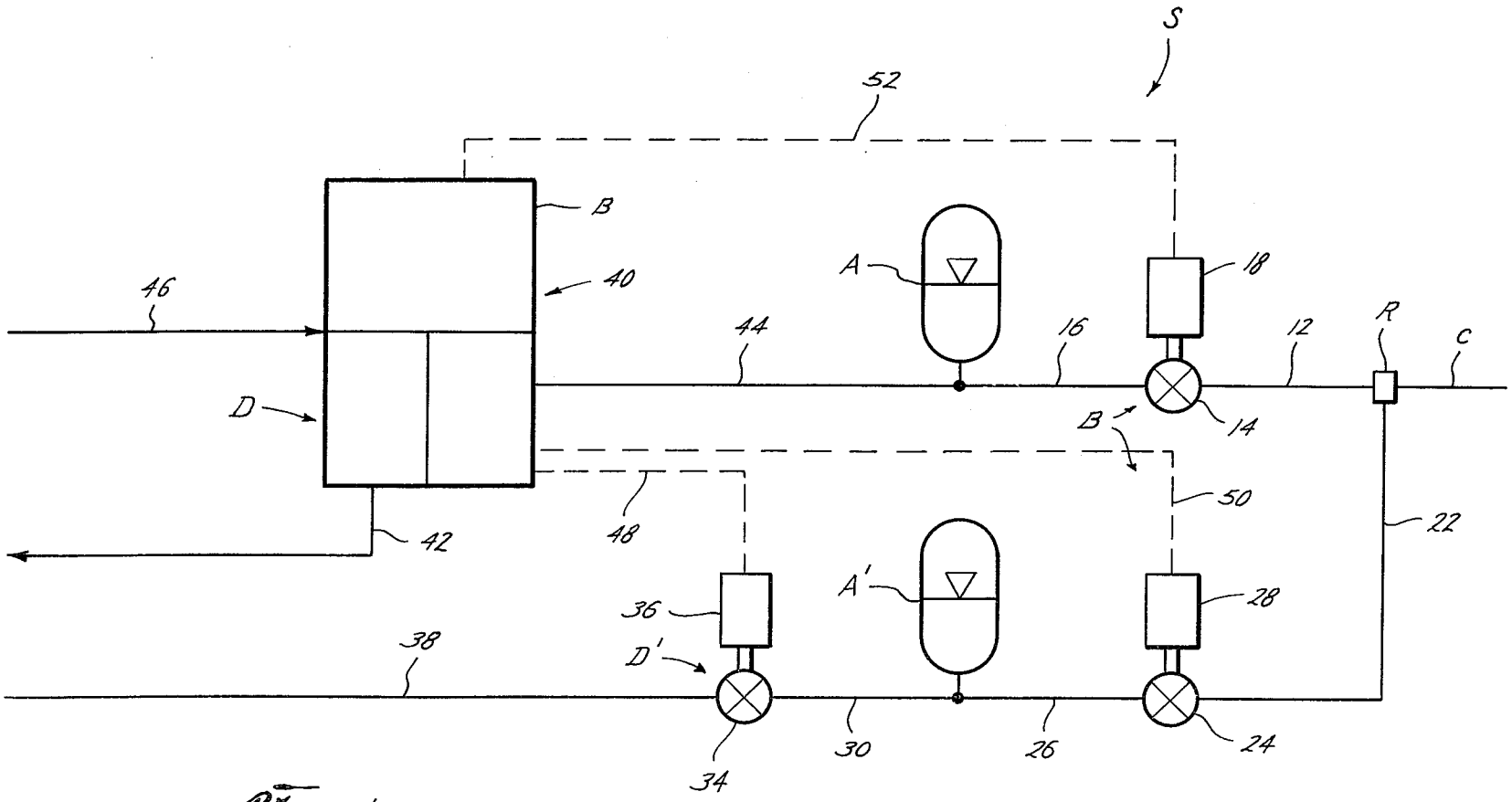
FIG. 1 is a schematic representation of the first embodiment of the present invention.

In the drawings, the letter S designates generally the system of the present invention for conveying fluid from a single subsea supply conduit C to provide a fluid supply to two or more of a plurality of subsea control apparatus D, D′, and D″. The system S includes a fluid receiving means R which receives fluid under pressure from the single subsea supply conduit C. In a first embodiment of the present invention (FIG. 1), a charging means B charges two or more accumulator means A and A' independently of one another with fluid from the receiving means R, and, once charged, the accumulator means A and A' supply fluid to their associated control devices D and D'. In a second embodiment of the present invention (FIG. 2), one of the control devices D' is an injection means I for injection fluid from the fluid receiving means into a subsea well flowline. In this second embodiment, a regulator means M is provided to control charging of accumulator means A and A' with fluid from the fluid receiving means R and to control fluid injection by the injection means I.

The system S of the present invention is particularly adapted for use on or near a subsea wellhead. The subsea supply conduit C extends to the system S from a remote location, typically the ocean surface. At the remote location, the conduit C is attached to a source of pressurized fluid, and the conduit conveys this pressurized fluid from the source to the receiving means R of the system S. The receiving means R is any suitable, commercially available flowline, coupling, connection, or the like which may be suitably joined with the conduit C to form a fluid tight seal and which provides a fluid passageway for fluid communication between the system S and the single subsea supply conduit C.

In the first embodiment of the present invention, the receiving means R is in interruptible fluid communication with a first accumulator A through a flowline 12, a first accumulator valve 14, and a flowline 16. The first accumulator valve 14 is movable by means of an actuator 18 between an open position and a closed position. In its open position, valve 14 permits fluid flow between flowlines 12 and 16 so that fluid from the single subsea supply conduit C flows through the fluid receiving means R, flowline 12, valve 14, and flowline 16 to charge accumulator A with fluid from the single subsea supply conduit C. With valve 14 in its closed position, fluid flow between flowlines 12 and 16 is blocked by the valve so that the first accumulator A is isolated from flowline 12, receiving means R, and the single subsea supply conduit C.

Similarly, a second accumulator A' is also in interruptible fluid communication with the receiving means R. A flowline 22, second accumulator valve 24, and a flowline 26 collectively provide an interruptible flow passageway from the receiving means R to the accumulator A'. The second accumulator valve 24 is movable between an open position and a closed position by an actuator 28. In its open position, the second accumulator valve 24 permits fluid flow between flowlines 22 and 26 so that fluid under pressure from the single subsea supply conduit C flows through the fluid receiving means R, line 22, valve 24, and line 26 to charge the accumulator A' with fluid from the single subsea supply conduit C. In its closed position, the second accumulator valve 24 blocks fluid flow between lines 22 and 26 so that the accumulator A' is isolated from line 22 and the fluid receiving means R.

When charged with fluid from the single subsea conduit C through the receiving means R, each of the accumulators A and A' supplies a subsea well control apparatus with operating or control fluid. In a preferred embodiment of the present invention, each of the accumulators supplies fluid to a separate control apparatus. As shown in FIG. 1, the second accumulator A' supplies fluid through a flowline 30 to D'. The control apparatus D' as shown is a two position valve 34 operated by an actuator 36 which controls operating fluid conveyed to in-line safety valves (not shown) or the like by a flowline 38. Valve 34 is opened and closed by actuator 36 upon receipt of an appropriate control signal to alternately allow fluid flow between lines 30 and 38 or block fluid flow between those lines. Once the accumulator A' has been charged with fluid from the supply conduit C and the fluid receiving means R, the second accumulator valve 24 is closed so that the fluid from the accumulator A' flows only in the direction of the control apparatus D'. When the control valve 34 is opened, fluid flows from accumulator A' through line 30, valve 34, and line 38 to supply operating fluid to the in-line control valves. Accordingly, accumulator A' provides a source of operating fluid to the control apparatus D'.

Similarly, accumulator A provides a source of operating fluid through a flowline 44 to control apparatus D which is a part of an electro-hydraulic control pod 40. Preferably, the electro-hydraulic control pod 40 is a conventional, commercially available ten function pod familiar to those having skill in the art. The control pod 40 has insulated electrical conductors 46 extending from it to a control panel located on the ocean surface. Control signals are transmitted to the electro-hydraulic control pod 40 by means of the conductor 46 to regulate hydraulic control signals and electrical control signals emitted from the control pod 40.

The control pod 40 serves both as well control apparatus D which supplies control signals to various well control valve assemblies and as a portion of the charging means B. A first hydraulic signal line 42 extends from the control pod 40 and may be operably attached to wellhead control valves such as the gate valves on a subsea christmas tree. In response to an appropriate electrical signal provided through conductor 46, the flow of the control pod operating fluid through the hydraulic signal line 42 is controlled so that the gate valves are opened and closed as desired. Additionally, the electro-hydraulic control pod 40 may be provided with a second hydraulic signal flowline 48 which extends to the actuator 36 of the control apparatus D'. In response to an appropriate control signal transmitted to pod 40 by conductor 46, the flow of operating fluid from the control pod 40 to the actuator 36 is regulated so that the actuator 36 opens and closes control valve 34 as desired to obtain the proper functioning of the in-line control valves operably attached to line 38.

As previously mentioned, the electro-hydraulic control pod 40 additionally serves as a portion of the charging means B for the system S. The charging means additionally includes the first accumulator valve 14, the second accumulator valve 24, and the actuators 18 and 28 associated with respective accumulator valves. The control pod 40 is provided with a hydraulic control line 50 which extends to the actuator 28 for opening and closing the second accumulator valve 24. In response to an appropriate electrical signal conveyed to pod 40 by conductor 46, operating fluid of the pod 40 is passed through the hydraulic signal line 50 to control the operation of actuator 28 and thereby control the opening and closing of valve 24. Additionally, the electro-hydraulic control pod 40 is provided with an insulated conductor 52 which extends from the control pod 40 to actuator 18. In response to an appropriate electrical control signal provided to pod 40 through conductor 46, an electrical control signal is transmitted from the pod 40 through conductor 52 to control the operation of actuator 18 and thereby control the opening and closing of the first accumulator valve 14.

The charging means B controls the fluid flow in the system S so that the first and second accumulators A and A' are charged independently of one another with fluid from the receiving means R. To charge the accumulators initially, a control signal is transmitted to the electro-hydraulic control pod 40 by conductor 46 which causes another electrical control signal to be transmitted through by conductor 52 to the actuator 18. In response to this latter control signal, the actuator 18 moves the first accumulator valve 14 to its open position so that fluid supplied through the single subsea conduit C flows through the receiving means R, flowline 12, valve 14, and flowline 16 to charge the first accumulator A. Once the charging of the first accumulator A is complete, another control signal is conveyed from the pod 40 to actuator 18 by means of conductor 52 to cause the actuator 18 to close the first accumulator valve 14. The accumulator A is thus isolated from the flowline 12 and fluid receiving means R, and the accumulator A supplies operating fluid to the control pod 40 through flowline 44. Since the control pod 40 has a source of operating fluid once the accumulator A has been charged, the control pod is then used to hydraulically control the charging of the second accumulator A'. An electrical control signal is supplied to the pod 40 through conductor 46 to cause a hydraulic fluid signal to be conveyed through flowline 50 to actuator 28. Upon receipt of the control signal the actuator 28 opens the second accumulator valve 24 and thereby permits fluid to flow from the subsea supply conduit C, through the fluid receiving means R, flowline 22, valve 24, and flowline 26 to charge the accumulator A' with fluid from the supply conduit C. Once the accumulator A' has been charged, another control signal is conveyed to the pod 40 by conductor 46, and the hydraulic signal through line 50 is removed to cause actuator 28 to close the second accumulator valve 24. Once the valve 24 is closed, the accumulator A' is isolated from flowline 22 and the fluid receiving means R and accumulator A' serves as a fluid supply for the control apparatus 3D'. Thus, it can be seen that the charging means B charges the first accumulator A and the second accumulator A' independently of one another with fluid from the fluid receiving means R.

Since the accumulators A and A' are in separate lines and are isolated from one another after either valve 14 or valve 24 is closed, the accumulators A and A' may be charged to different pressure levels. With the single subsea supply conduit C operably connected to a source of pressurized fluid which alternately provides fluid at desired, different pressure levels, the opening and closing of the accumulator valves 14 and 24 may be regulated so that the respective accumulators A and A' are charged with fluid at different pressure levels. When the single subsea supply conduit C conveys fluid to the fluid receiving means R at a first pressure level, an electrical control signal is conveyed to pod 40 by conductor 46, and a control signal is passed over conductor 52 to actuator 18 which causes the valve 14 to open. With the valve 14 open, the first accumulator A receives fluid at a first pressure level from the fluid receiving means R and is thereby charged with fluid at that first pressure level. Another control signal is then conveyed to pod 40 through conductor 46, causing a control signal to be transmitted to actuator 18 over conductor 52 to close the first accumulator valve 14 and thereby isolate the first accumulator A from the fluid receiving means R. The source of pressurized fluid is then regulated to provide fluid through the supply conduit C at a second pressure level. A suitable control signal is next conveyed to control pod 40 by conduit 46 to cause a hydraulic signal to be conveyed by line 50 to actuator 28, causing the actuator 28 to open the second accumulator valve 24. The second accumulator A' is thus placed in fluid communication with the fluid receiving means R and is charged with fluid at the second pressure level. After the charging of the second accumulator A' has been completed, an additional control signal is conveyed to control pod 40 over conductor 46 to cause a different control signal to be transmitted to actuator 28 by flowline 50 and to close the second accumulator valve 24. Thus, both accumulators are isolated from one another and have been charged with fluid at different pressure levels to provide appropriate fluid supplies to their respective well control devices D and D'.

Figure 2:
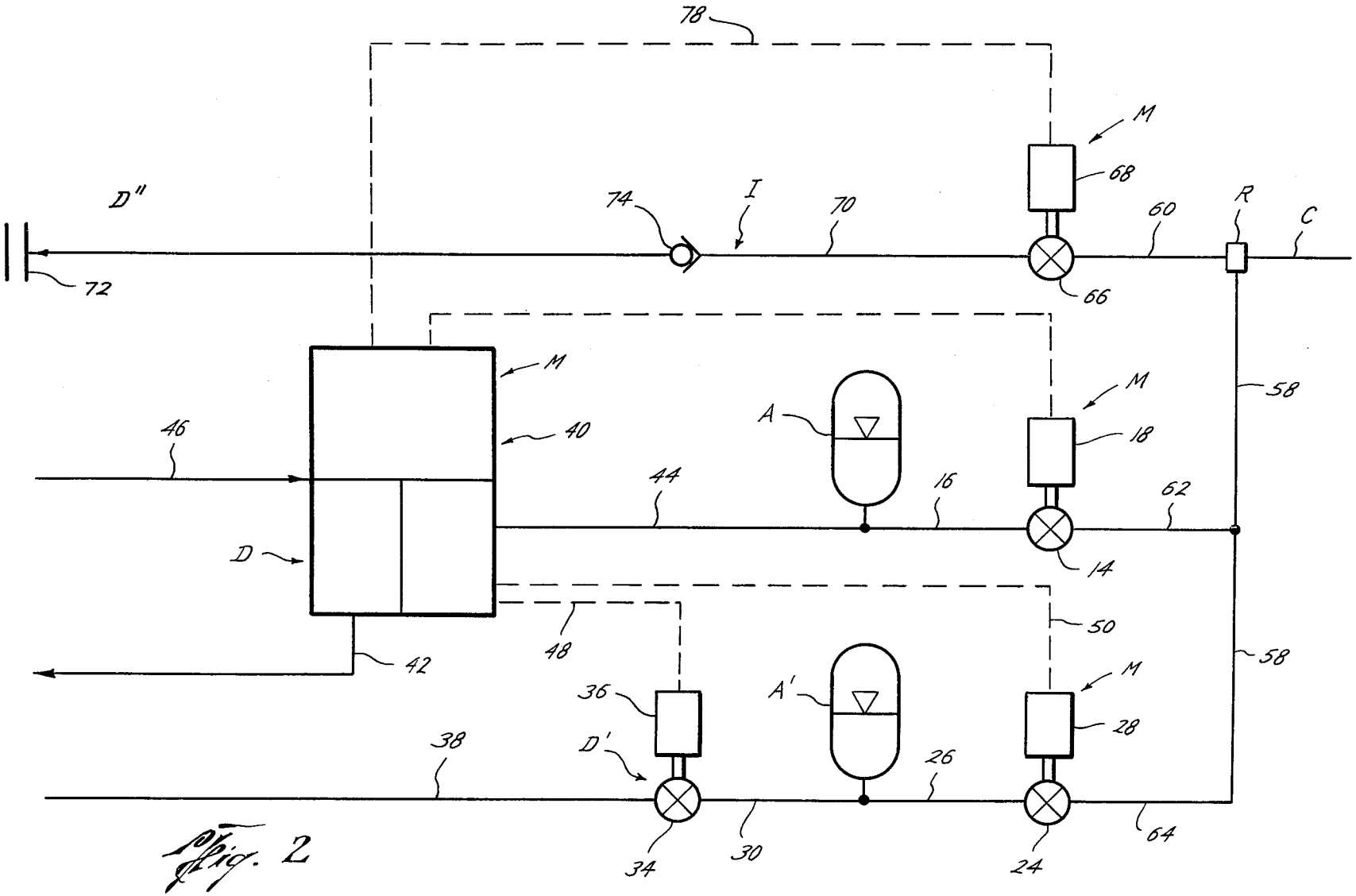
FIG. 2 is a schematic representation of a second embodiment of the present invention.

The second embodiment of the present invention is schematically illustrated in FIG. 2. Many of the elements shown in FIG. 3 are substantially identical in structure and perform the same functions performed by corresponding elements previously described herein with reference to the first embodiment of the present invention. Accordingly, like letters and numerals are used in FIGS. 1 and 2 to designate like elements.

The second embodiment of the present invention is a system for conveying fluid from the single subsea supply conduit C to provide a fluid supply for both subsea well valve control apparatus and fluid injection apparatus. The fluid receiving means R is in fluid communication with flowlines 58 and 60. The flowline 58 is operably connected to a first feeder conduit 62 so that a fluid passageway is provided between the fluid receiving means R and the first accumulator valve 14. Similarly, a second feeder conduit 64 is connected to the flowline 58 to place the fluid receiving means R in fluid communication with the second accumulator valve 24. The flowline 60 maintains the fluid receiving means R in fluid communication with an injection valve 66 which is movable between open and closed positions by an actuator 68. With the valve 66 in its open position, the valve passes fluid between the flowline 60 and an injection line 70. With the valve 66 in its closed position, the valve blocks fluid flow between the flowline 60 and the injection line 70.

The injection line 70 is a part of the fluid injection means I for injecting a fluid into a subsea well flowline 72. The injection line 70 may be provided with a check valve 74 to ensure that fluid in line 70 flows only from the injection valve 66 toward the well flowline 72.

The injection line 70 is provided to convey a freezing retardant fluid into the well flowline 72 when the injection valve 66 is open. Once injected into the well flowline 72, the freezing retardant fluid retards or eliminates the freezing of fluids in the well flowline. With the second embodiment of the present invention, the subsea supply conduit C conveys such a freezing retardant fluid to the fluid receiving means R. Preferably, the freezing retardant fluid is glycol or methanol, but other suitable freezing retardant fluids may be utilized.

With the second embodiment of the present invention, the freezing retardant fluid supplied by the single subsea supply conduit C through the fluid receiving means R not only serves as the injection fluid which is injected into the well flowline 72, but also serves as the fluid medium for charging both the first accumulator A and the second accumulator A'. In this manner, only one type of pressurized fluid needs to be supplied through the single subsea supply conduit C. Yet, a suitable source of fluid is provided by the system S for injecting fluid into the well flowline 72 and for providing fluid supplies for the subsea well valve control apparatus.

With the second embodiment of the present invention, the regulating means M controls injection of fluid by the injection means I and controls the charging of the accumulators A and A'. The regulating means M includes a portion of control pod 40, accumulator valves 14 and 24, injection valve 66, and the associated actuators 18, 28, and 68. The injection valve 66 and the accumulator valves 14 and 24 are initially in their closed positions. An electrical control signal is supplied to the electro-hydraulic control pod 40 by conductor 46 to cause an electrical control signal to be conveyed by conductor 52 to the actuator 18 to open the first accumulator valve 14. With the first accumulator valve in its open position, fluid flows from the supply conduit C through the receiving means R, flowline 58, feeder conduit 62, valve 14, and line 16 to charge the first accumulator A with fluid. Subsequent to the charging of the first accumulator A, a second control signal is transmitted to the electro-hydraulic control pod 40 by conductor 46 to cause a different control signal to be transmitted to actuator 18 by conductor 52 so that the first accumulator valve 14 is closed. With the closing of the first accumulator valve 14 subsequent to the charging of the first accumulator A, the electro-hydraulic control pod 40 is provided with a source of operating fluid from the accumulator A through flowline 44. Another control signal is then conveyed to the control pod 40 by conductor 46 to cause a hydraulic pressure signal to be conveyed to actuator 28 through the actuator signal conduit 50. This signal causes the actuator 28 to open the second accumulator valve 24. With the second accumulator valve 24 is its open position, fluid flows from the subsea supply conduit C through the fluid receiving means R, flowline 58, feeder conduit 64, valve 24, and line 26 to charge the second accumulator A' with fluid from the single subsea supply conduit. Subsequent to the completion of the charging of the second accumulator A', another control signal is conveyed to the control pod by conductor 46, causing a different hydraulic control signal to be conveyed to actuator 28 through conduit 50. This latter hydraulic control signal causes the actuator 28 to close the second accumulator valve 24. At this point, both the first accumulator A and the second accumulator A' are charged with fluid and provide a fluid supply to the control pod 40 and the control apparatus D', respectively. The injection valve 66 may now be opened as desired to inject fluid from the single subsea supply conduit C into the well flowline 72 to prevent freezing in the latter flowline. A hydraulic signal conveying conduit 78 extends between the control pod 40 and the actuator 68 to permit control of the opening and closing of the injection valve 66. Upon receipt of an appropriate control signal over conductor 46 by the control pod 40, a hydraulic pressure is exerted through the conduit 78 to the actuator 68 to cause the injection valve 66 to open, With the valve 66 in its open position, fluid is conveyed from the single subsea supply conduit C, through the fluid receiving means R, flowline 60, injection valve 66, and injection line 70 into the well control flowline 72. Thus, with the second embodiment of the present invention, fluid is conveyed from the single subsea supply conduit C to provide a fluid supply for both the well valve control apparatus and the injection apparatus I.

It will be appreciated, of course, that accumulators A and A' may be charged to different pressure levels and injection of fluid into well flowline 72 may be accomplished at yet a different pressure level. Where the single subsea supply conduit C is connected to pressurized fluid source which alternatively supplies fluid at three pressure levels, the opening and closing of valves 14, 24, and 66 may be regulated by appropriate signals to the control pod 40 to open the respective valves individually and at times when an appropriate pressure level is present in the fluid supply through the single supply conduit C.

Preferably, each of the valves described herein have a failsafe closed construction. In this manner, leakage of fluid from either the system S or the control apparatus is reduced or eliminated in the event of a break in the associated flowlines or conduits.

It should be understood, of course, that many variations of either of the two embodiments of the present invention described above are possible without departing from the spirit of the invention. For example, in the first embodiment of the present invention, additional accumulators could be connected to the fluid receiving means R to supply the same or other well control apparatus D. Similarly, in the second embodiment of the present invention, a single accumulator could be used with the fluid injection means I rather than having two accumulators as specifically illustrated in FIG. 3.

However, with any of the embodiments of the present invention, fluid is supplied to a plurality of well control apparatus using only a single subsea supply conduit C. Additional supply conduits from the ocean surface are eliminated, thus substantially reducing the expenditures necessary when utilizing the system of the present invention. With each of the embodiments of the system S, multipressure supply levels are possible without having to utilize active pumping means which add to the inherent unreliability of known supply systems.

The foregoing disclosure and description of the invention are illustrative and explanatory thereof, and various changes in the size, shape, and materials as well as in the details of the illustrated construction may be made without departing from the spirit of the invention.

I claim:

1. A system for conveying fluid from a single subsea supply conduit to provide a fluid supply for both subsea well valve control apparatus and fluid injection apparatus, comprising:

fluid receiving means for receiving fluid under pressure from a single subsea supply conduit;

injection means operably connected to said fluid receiving means for injecting fluid from said fluid receiving means into a subsea well flowline;

accumulator means for supplying fluid to a subsea well valve control apparatus;

said accumulator means being in interruptible fluid communication with said fluid receiving means for being charged with fluid from said fluid receiving means; and regulating means operably connected to said fluid receiving means, said injection means, and said accumulator means for regulating fluid flow from said fluid receiving means to control injection by said injection means and to control charging of said accumulator means, whereby said injection means and said accumulator means are both supplied with fluid from a single subsea supply conduit.

2. The structure set forth in claim 1, wherein the single subsea supply conduit alternately provides fluid to said fluid receiving means at first and second pressure levels and said regulating means includes:

injection valve means for regulating fluid flow between said receiving means and said injection means;

accumulator valve means for regulating fluid flow between said fluid receiving means and said accumulator means; and electro-hydraulic control means operably connected to said injection valve means and said accumulator valve means for actuating said accumulator valve means to charge said accumulator means with fluid at the first pressure level and for actuating said injection valve means to supply fluid at the second pressure level to said injection means.

3. The structure set forth in claim 2, wherein:

said accumulator means supplies operating fluid to said electro-hydraulic control means; and said electro-hydraulic control means includes electrical actuator means for electrically actuating said accumulator valve means for charging said accumulator means.

4. The structure set forth in claim 1, wherein the single subsea supply conduit provides a freezing retardant fluid to said receiving means and wherein:

said injection means injects a freezing retardant fluid into a subsea well flowline.

5. The structure set forth in claim 4, wherein said freezing retardant fluid is glycol.

6. The structure set forth in claim 4, wherein said freezing retardant fluid is methanol.

7. The structure set forth in claim 1, further including:

a second accumulator means for supplying fluid to a second subsea well valve control apparatus.

8. The structure set forth in claim 7, wherein the single subsea supply conduit alternatively provides fluid to said fluid receiving means at first, second, and third pressure levels and said regulating means includes:

injection valve means for regulating fluid flow between said fluid receiving means and said injection means;

first accumulator valve means for regulating fluid flow between said fluid receiving means and said first accumulator means;

second accumulator valve means for regulating fluid flow between said fluid receiving means and said second accumulator means; and electro-hydraulic control means operably connected to said injection valve means and said first and second valve means for actuating said first accumulator valve means to charge said first accumulator with fluid at the first pressure level, for actuating said second accumulator valve means to charge said second accumulator means with fluid at the second pressure level, and for actuating said injection valve means to supply fluid at the third pressure level to said injection means.

9. The structure set forth in claim 8, wherein:

said electro-hydraulic control means includes hydraulic actuator means for hydraulically actuating said injection valve means and said second accumulator valve means.

10. The structure set forth in claim 9, wherein:

said first accumulator means supplies operating fluid to said electro-hydraulic control means; and said electro-hydraulic control means includes electrical actuator means for electrically actuating said first actuator valve means for charging said first accumulator means.

11. A system for conveying fluid from a single subsea supply conduit to provide a fluid supply for a plurality of subsea well valve control apparatus, comprising:

fluid receiving means for receiving fluid under pressure from a single subsea supply conduit;

first accumulator means for supplying fluid to a first subsea well valve control apparatus;

second accumulator means for supplying fluid to a second subsea well valve control apparatus;

said first and second accumulator means being in interruptible fluid communication with said fluid receiving means for being charged with fluid from said fluid receiving means; and charging means operably connected to said fluid receiving means, said first accumulator means, and said second accumulator means for charging said first and second accumulator means independently of one another with fluid from said fluid receiving means.

12. The structure set forth in claim 11, wherein the single subsea supply conduit alternately provides fluid to said fluid receiving means at first and second pressure levels and wherein said charging means includes:

first accumulator valve means for regulating fluid flow between said fluid receiving means and said first accumulator means;

second accumulator valve means for regulating fluid flow between said fluid receiving means and said second accumulator means;

electro-hydraulic control means operably connected to said first and second accumulator valve means for actuating said first accumulator valve means to charge said first accumulator with fluid at the first pressure level and for actuating said second accumulator valve means to charge said second accumulator means with fluid at the second pressure level.

13. The structure set forth in claim 12, wherein:

said first accumulator means supplies fluid to said electro-hydraulic control means; and said electro-hydraulic control means includes electrical actuator means for electrically actuating said first accumulator valve means for charging said first accumulator means.

14. The structure set forth in claim 12, wherein:

said electro-hydraulic control means includes hydraulic actuator means for hydraulically actuating said second accumulator valve means.

* * * * *